US012357070B2

(12) United States Patent
Castillo

(10) Patent No.: US 12,357,070 B2
(45) Date of Patent: Jul. 15, 2025

(54) BEARD TEMPLATE MASK AND ASSOCIATED METHOD(S)

(71) Applicant: Roberto Castillo, Sanford, FL (US)

(72) Inventor: Roberto Castillo, Sanford, FL (US)

( * ) Notice: Subject to any disclaimer, the term of this patent is extended or adjusted under 35 U.S.C. 154(b) by 451 days.

(21) Appl. No.: 17/932,123

(22) Filed: Sep. 14, 2022

(65) Prior Publication Data

US 2023/0081966 A1 Mar. 16, 2023

Related U.S. Application Data

(60) Provisional application No. 63/243,931, filed on Sep. 14, 2021.

(51) Int. Cl.
*A45D 27/42* (2006.01)

(52) U.S. Cl.
CPC ..... *A45D 27/42* (2013.01)

(58) Field of Classification Search
CPC ..... A45D 27/00; A45D 27/003; A45D 27/42; A45D 44/002; A45D 44/12; A45D 40/30
See application file for complete search history.

(56) References Cited

U.S. PATENT DOCUMENTS

| | | | | |
|---|---|---|---|---|
| 2,473,926 | A * | 6/1949 | Wesley, Sr. | A45D 27/003 604/303 |
| 10,646,016 | B2 * | 5/2020 | Alvarez | A45D 27/42 |
| 2017/0119127 | A1 * | 5/2017 | Krost | A45D 27/42 |
| 2021/0059377 | A1 * | 3/2021 | Tulit | A45D 44/002 |
| 2021/0100335 | A1 * | 4/2021 | Cangialosi | A45D 40/30 |
| 2022/0125132 | A1 * | 4/2022 | Murphy | A45D 44/00 |

* cited by examiner

*Primary Examiner* — Rachel R Steitz
*Assistant Examiner* — Karim Asqiriba
(74) *Attorney, Agent, or Firm* — Ashkan Najafi

(57) ABSTRACT

A beard template mask includes a flexible body having a left side shield, a right side shield, an upper lip shield intermediately and detachably coupled to the left side shield and the right side shield, a first fastener removably attached to an anterior region of the left side shield and the right side shield, a second fastener removably attached to a posterior region of the left side shield and the right side shield, a first support member removably attached to the left side shield and being configured to rest on a left ear of the user, and a second support member removably attached to the right side shield and being configured to rest on a right ear of the user.

18 Claims, 11 Drawing Sheets

BEARD TEMPLATE MASK AND ASSOCIATED METHOD(S)

CROSS REFERENCE TO RELATED APPLICATIONS

This is a non-provisional patent application that claims priority to and benefit of co-pending U.S. provisional patent application No. 63/243,931 filed Sep. 14, 2021, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to facial grooming devices and, more particularly, to an adjustable and disposable beard template mask for assisting a user to trim a beard.

Prior Art

There are a variety of hairline shaping tools that serve as a template available for facial and neckline grooming. A user may utilize a hairline shaping tool to create a desired beard line on face or neck, sideburns, back of the neck, or any other body areas where a hairline is present. These shaping tools that are known in the art have several disadvantages, making them not suitable for creating a nice neckline. The majority of these shaping tools are rigid and difficult to conform and fit to a face in a conformable manner. Some shaping tools are wearable around neck but only for trimming the hair on the back of the neck.

Front necks are a specific problem area to shave correctly as curves are quite evident. A few of these known tools may be somewhat flexible, but still fall short of making conformable contact, particularly with the curve of a neckline. Current templates must be held firmly in place with one hand while in use and it is difficult to get a consistent and symmetric neckline and it is also challenging to trim beard with one hand while holding the template with the other hand.

Accordingly, a need remains for a beard template mask in order to overcome at least one of the above-noted shortcomings. The exemplary embodiment(s) satisfy such a need by an adjustable and disposable beard template mask that is convenient and easy to use, lightweight yet durable in design, versatile in its applications, and designed for assisting a user to trim a beard.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a beard template mask for assisting a user to trim a beard. These and other objects, features, and advantages of the non-limiting exemplary embodiment(s) are provided by a beard template mask including a flexible body suitably sized and shaped to sit on a face of the user. Such a flexible body includes a left side shield suitably sized and shaped to cover a left side of a user face while exposing lips and a chin of the user, a right side shield suitably sized and shaped to cover a right side of the user face while exposing the lips and the chin of the user, an upper lip shield intermediately and detachably coupled to the left side shield and the right side shield, and being suitably sized and shaped to cover a mustache region of a user face, a first fastener removably attached to an anterior region of the left side shield and the right side shield, a second fastener removably attached to a posterior region of the left side shield and the right side shield, a first support member removably attached to the left side shield and being configured to rest on a left ear of the user, and a second support member removably attached to the right side shield and being configured to rest on a right ear of the user. Each of the left side shield and the right side shield is generally L-shaped. Each of the first support member and the second support member is substantially L-shaped.

In a non-limiting exemplary embodiment, a width of the body is adjustable via the first fastener and the second fastener to conform to a contour of a face of the user.

In a non-limiting exemplary embodiment, the body further includes an open anterior face disposed between the left side shield and the right side shield and positioned at the chin of the user.

In a non-limiting exemplary embodiment, each of the left side shield and the right side shield are configured to cover a major surface area of a left jaw region and a right jaw region of a user.

In a non-limiting exemplary embodiment, the upper lip shield has an inverse and substantially U-shape and is configured to conform to a lip contour of the user lip and remain disposed beneath a nose of the user.

In a non-limiting exemplary embodiment, the first fastener includes a first pair of elongated tethers, and the second fastener includes a second pair of elongated tethers spaced from the first pair of elongated tethers.

In a non-limiting exemplary embodiment, the first pair of elongated tethers are tied together at the anterior region.

In a non-limiting exemplary embodiment, the second pair of elongated tethers are tied together at the posterior region.

In a non-limiting exemplary embodiment, each of the first support member and the second support member has a substantially L-shape.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
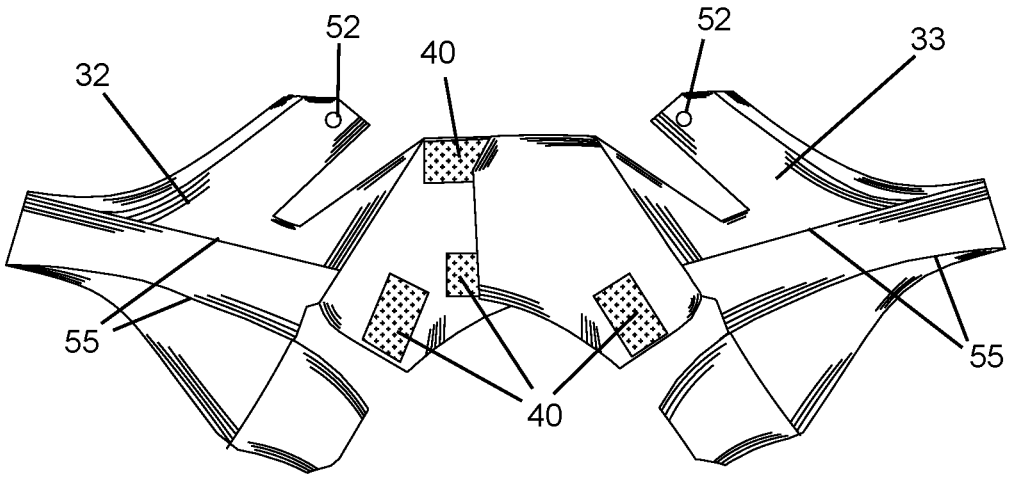
FIG. 1 is a top plan view of a portion of a beard template mask disposed at a partially unfolded position, in accordance with a non-limiting exemplary embodiment of the present disclosure.
Figure 2:
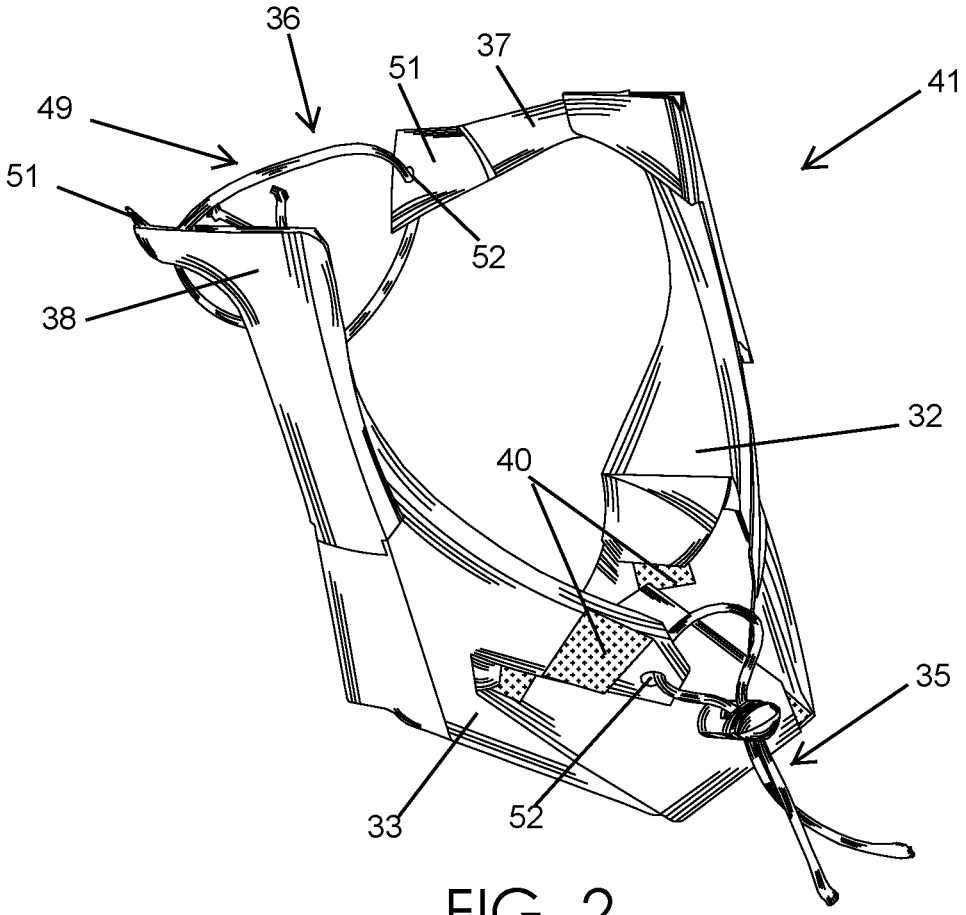
FIG. 2 is a perspective view of a beard template mask disposed at a folded and operating position, in accordance with a non-limiting exemplary embodiment of the present disclosure.
Figure 3:
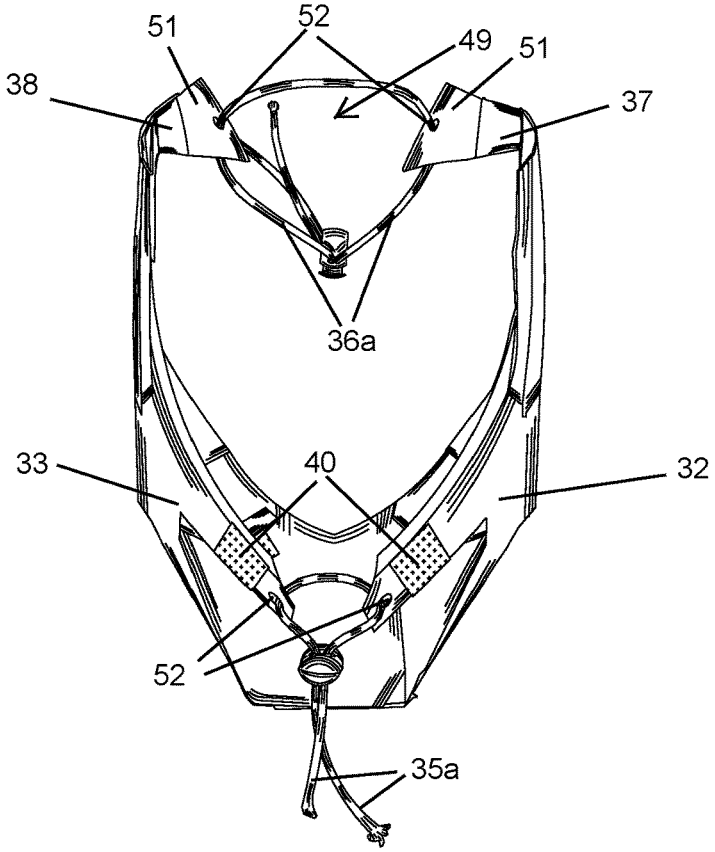
FIG. 3 is a front elevational view of the beard template mask shown in FIG. 2, in accordance with a non-limiting exemplary embodiment of the present disclosure.
Figure 4:
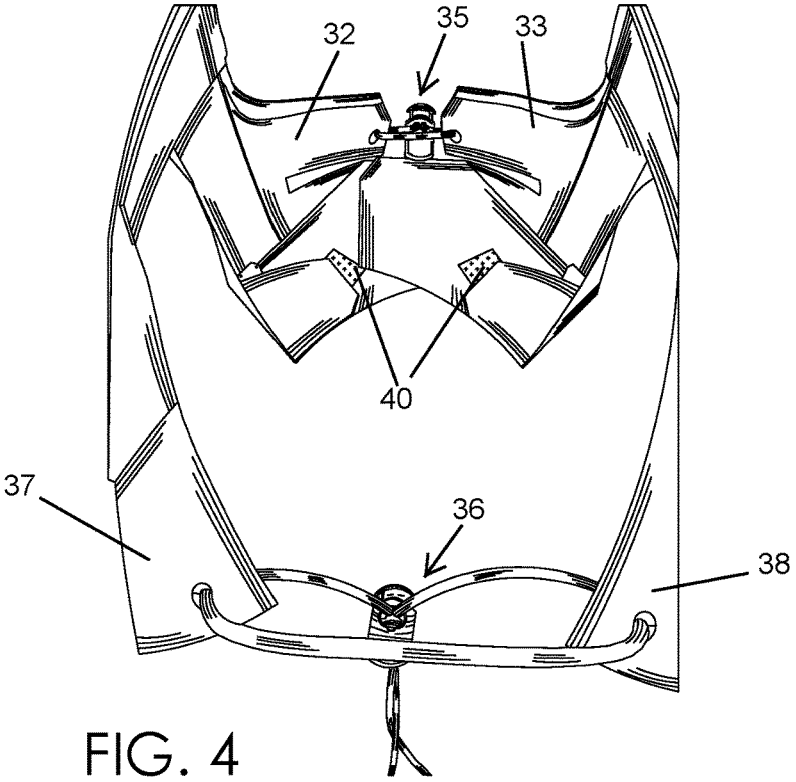
FIG. 4 is a rear elevational view of the beard template mask shown in FIG. 2, in accordance with a non-limiting exemplary embodiment of the present disclosure.
Figure 5:
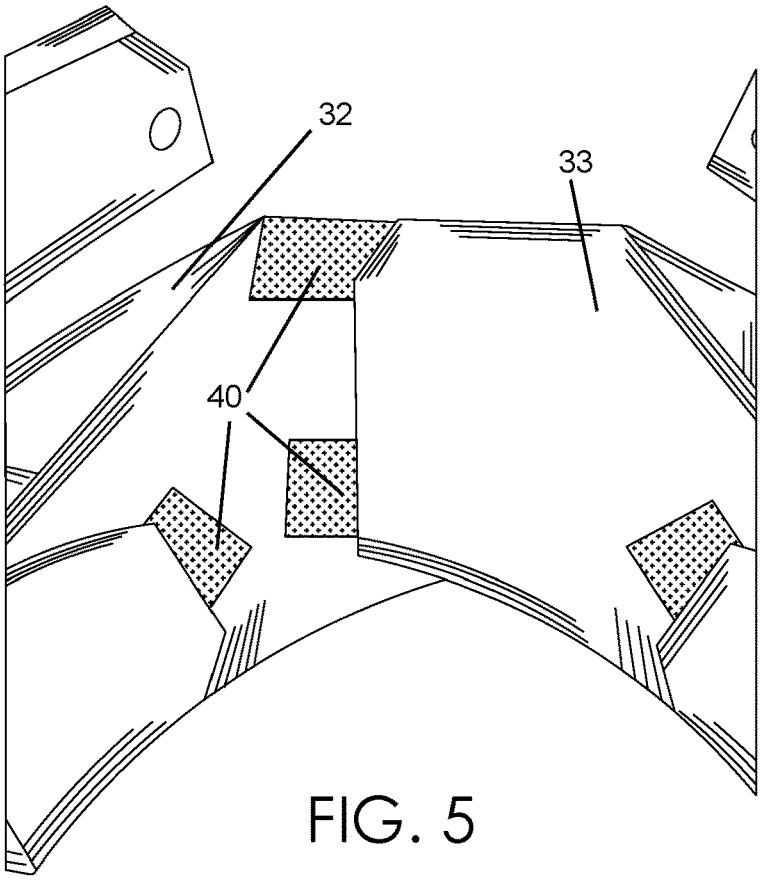
FIG. 5 is an enlarged view of a juncture between the right side shield and the left side shield shown in FIG. 1, in accordance with a non-limiting exemplary embodiment of the present disclosure.
Figure 6:
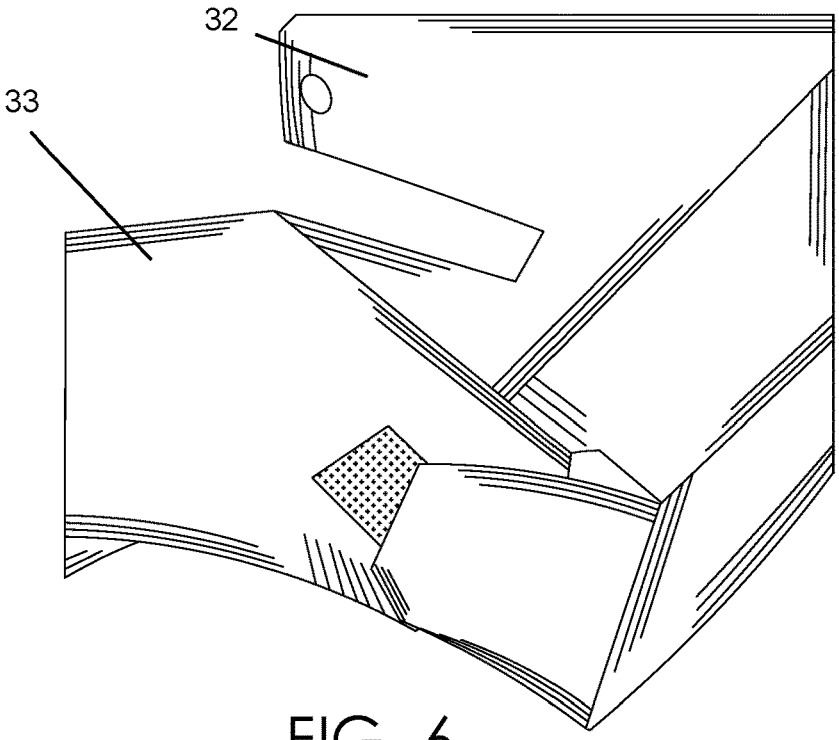
FIG. 6 is an enlarged perspective view of an anterior section of the beard template mask, in accordance with a non-limiting exemplary embodiment of the present disclosure.
Figure 7:
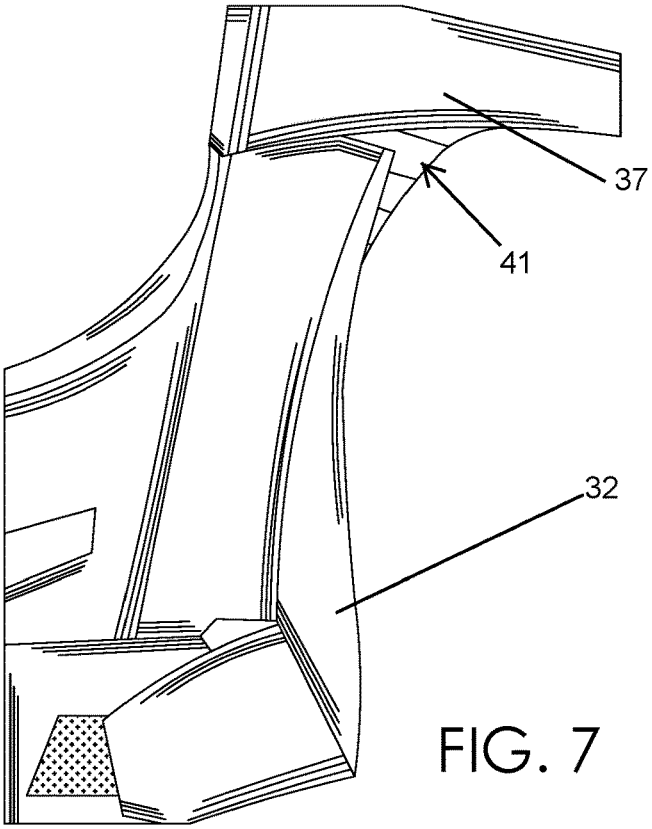
FIG. 7 is an enlarged side elevational view of a support member shown in FIG. 2, in accordance with a non-limiting exemplary embodiment of the present disclosure.
Figure 8:
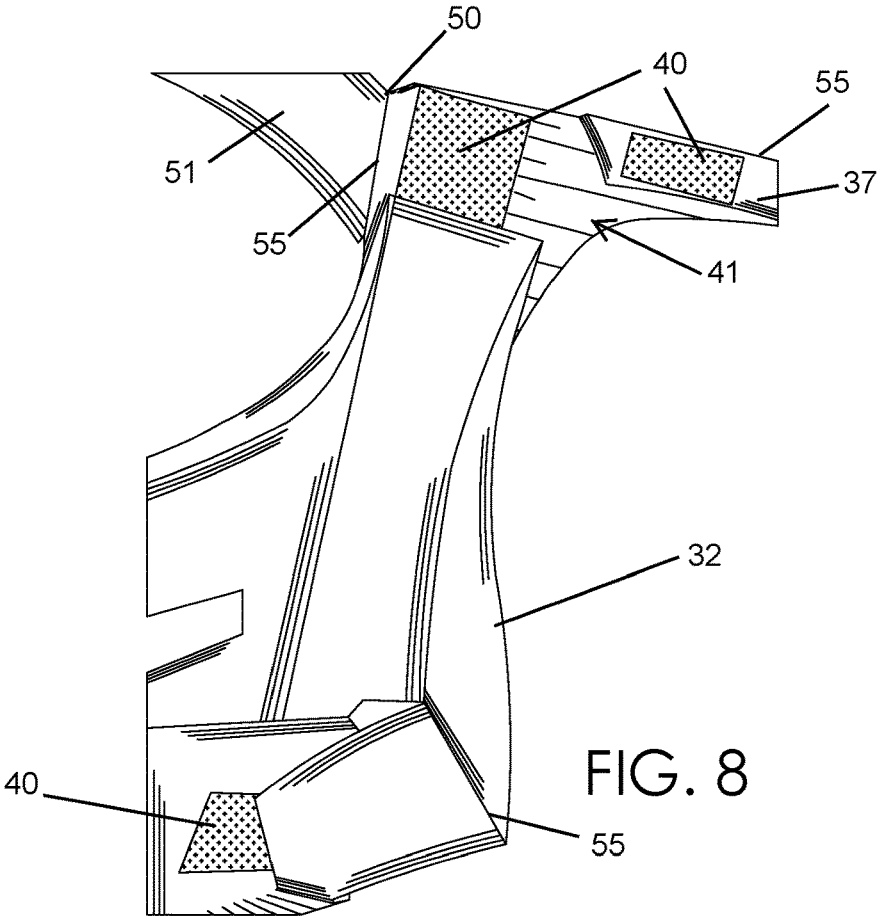
FIG. 8 is another enlarged side elevational view of the support member shown in FIG. 7 wherein selected fasteners are exposed, in accordance with a non-limiting exemplary embodiment of the present disclosure.
Figure 9:
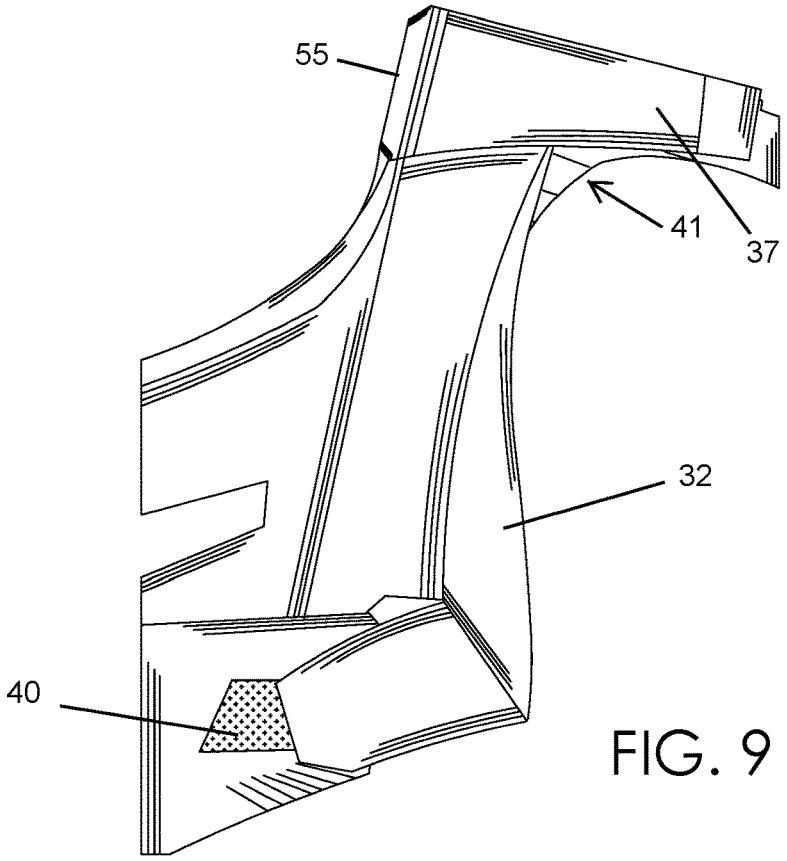
FIG. 9 is another enlarged side elevational view of the support member shown in FIG. 2 wherein selected fasteners are covered, in accordance with a non-limiting exemplary embodiment of the present disclosure.
Figure 10:
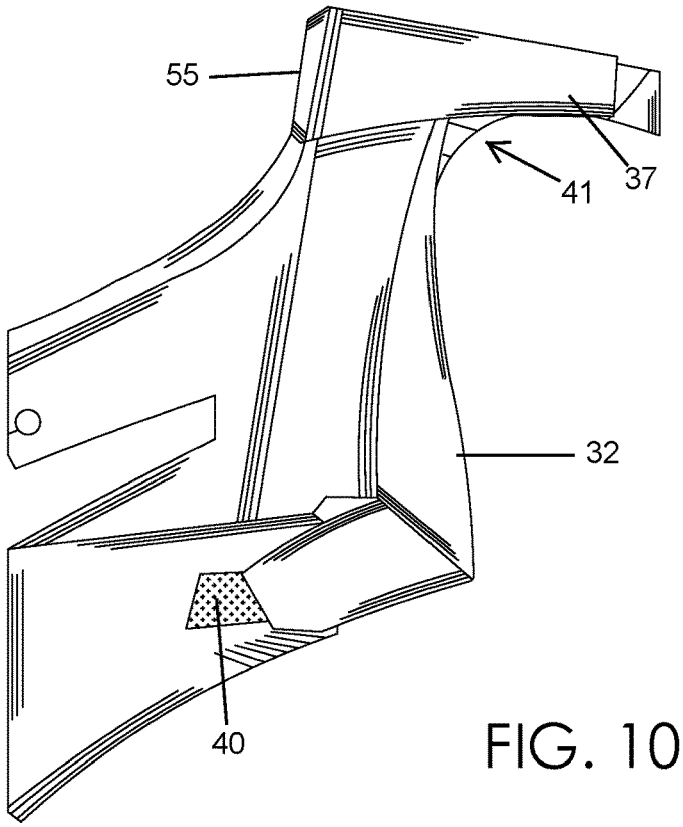
FIG. 10 is another enlarged side elevational view of the support member shown in FIG. 9 wherein selected fasteners are exposed, in accordance with a non-limiting exemplary embodiment of the present disclosure.
Figure 11:
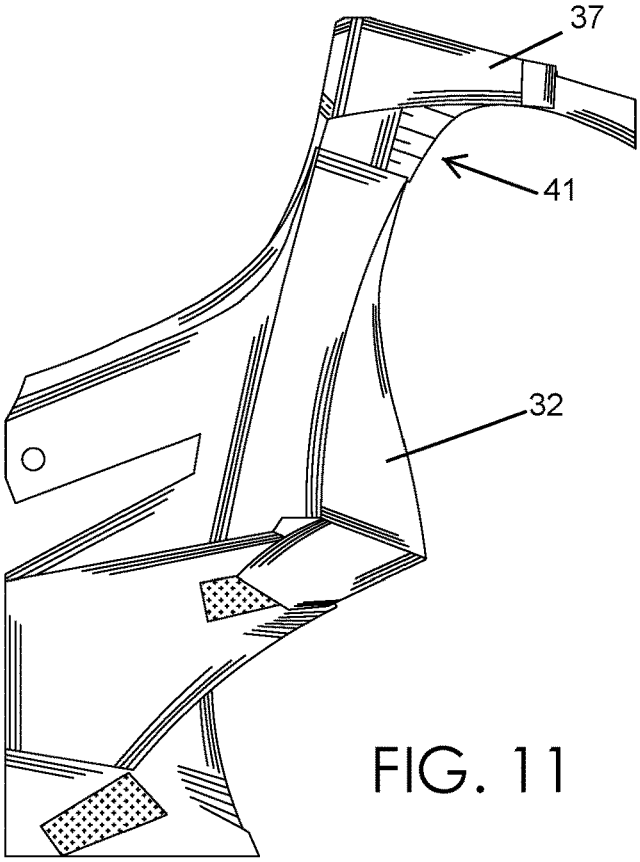
FIG. 11 is another enlarged side elevational view of the support member shown in FIG. 2 wherein selected fasteners are exposed and other fasteners are covered, in accordance with a non-limiting exemplary embodiment of the present disclosure.
Figure 12:
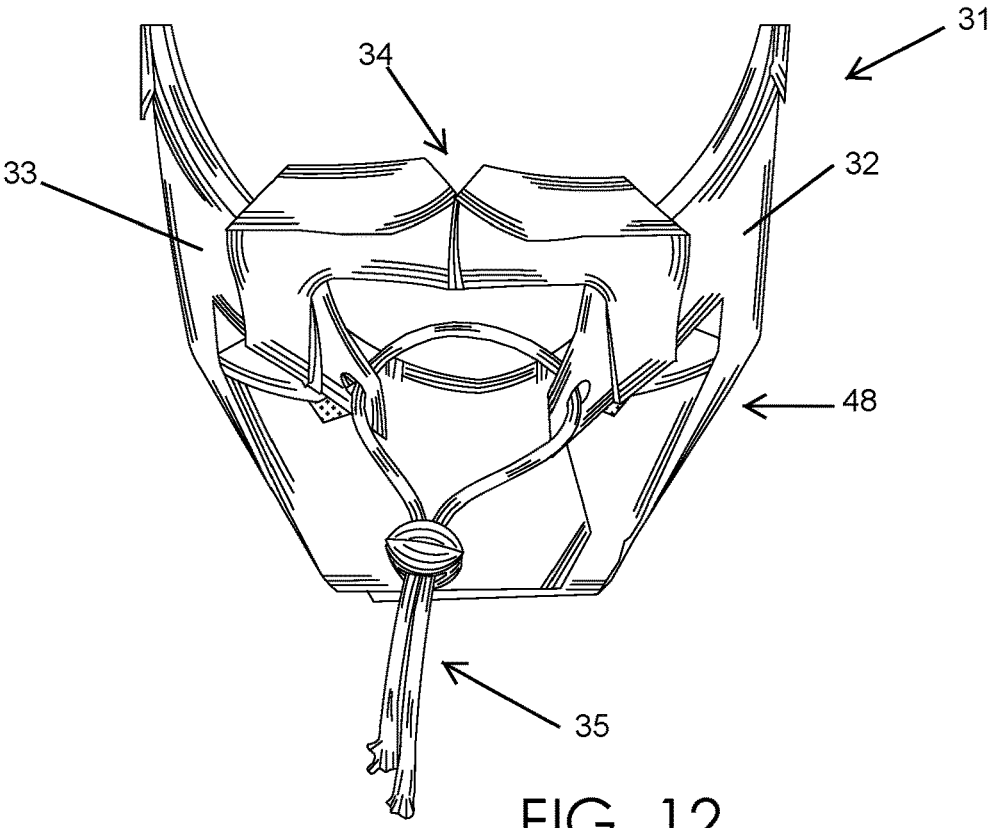
FIG. 12 is front elevational view of a beard template mask having a upper lip shield, in accordance with a non-limiting exemplary embodiment of the present disclosure.
Figure 13:
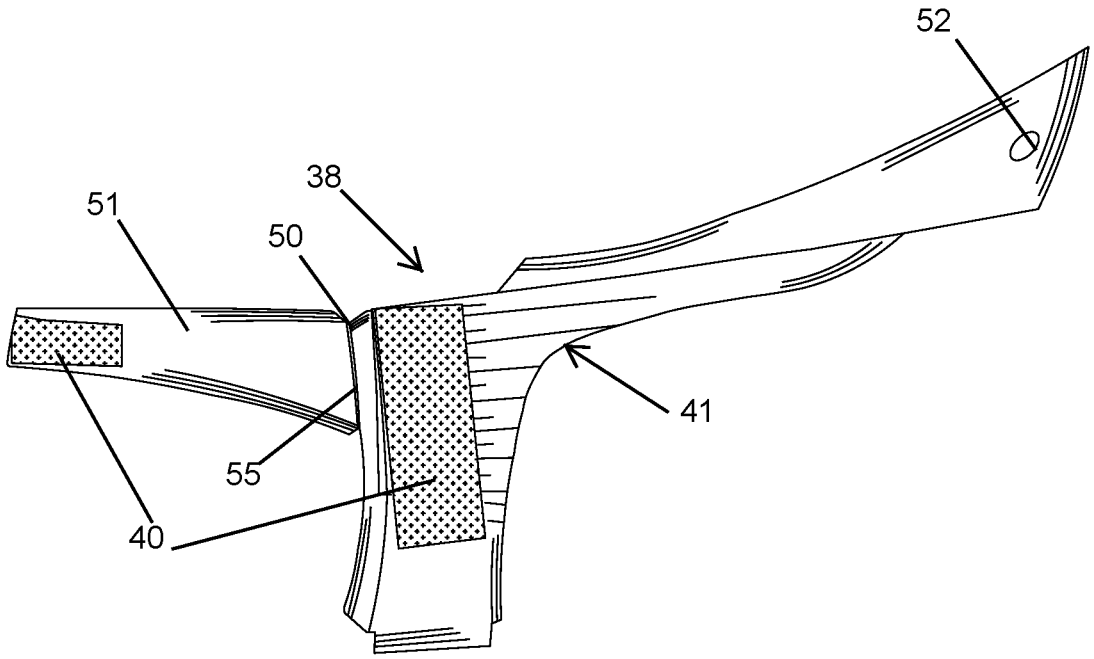
FIG. 13 is a side elevational view of a shield member shown in FIG. 2 wherein selected fasteners are exposed, in accordance with a non-limiting exemplary embodiment of the present disclosure.
Figure 14:
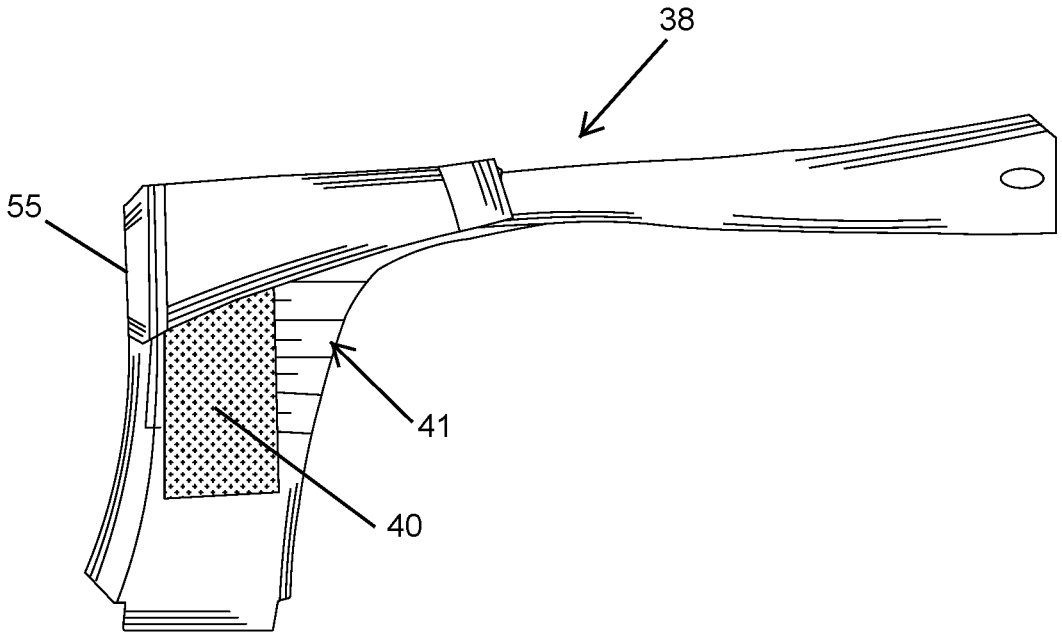
FIG. 14 is another side elevational view of the shield member shown in FIG. 13 wherein selected fasteners are exposed and other fasteners are covered, in accordance with a non-limiting exemplary embodiment of the present disclosure.
Figure 15:
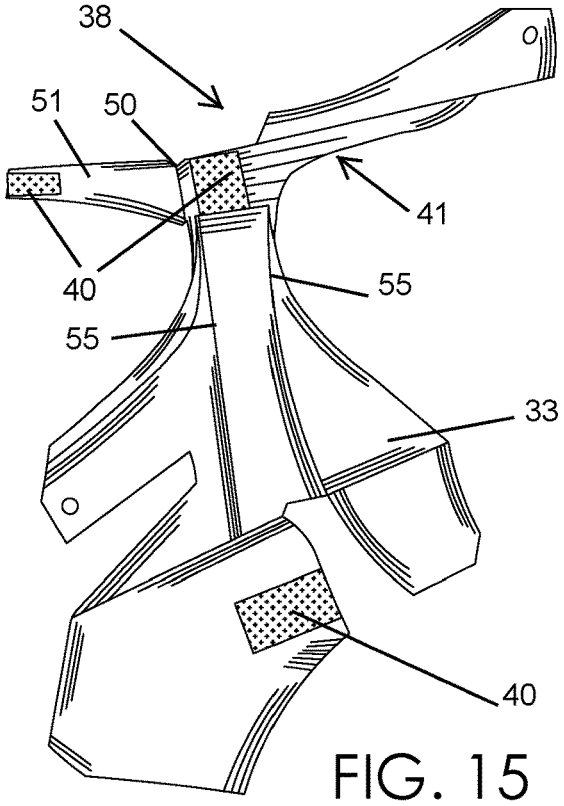
FIG. 15 is another side elevational view of the shield member shown in FIG. 2 wherein selected fasteners are exposed, in accordance with a non-limiting exemplary embodiment of the present disclosure.
Figure 16:
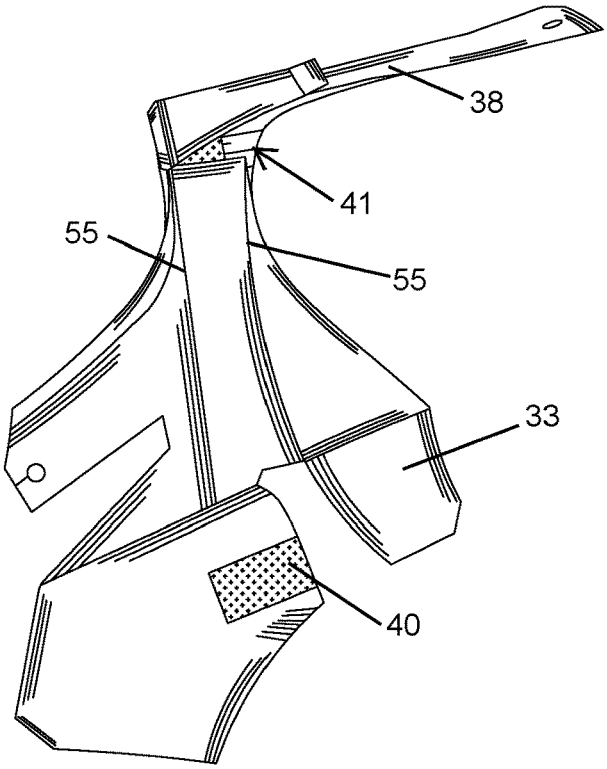
FIG. 16 is another side elevational view of the shield member shown in FIG. 15 wherein selected fasteners are exposed and other fasteners are covered, in accordance with a non-limiting exemplary embodiment of the present disclosure.
Figure 17:
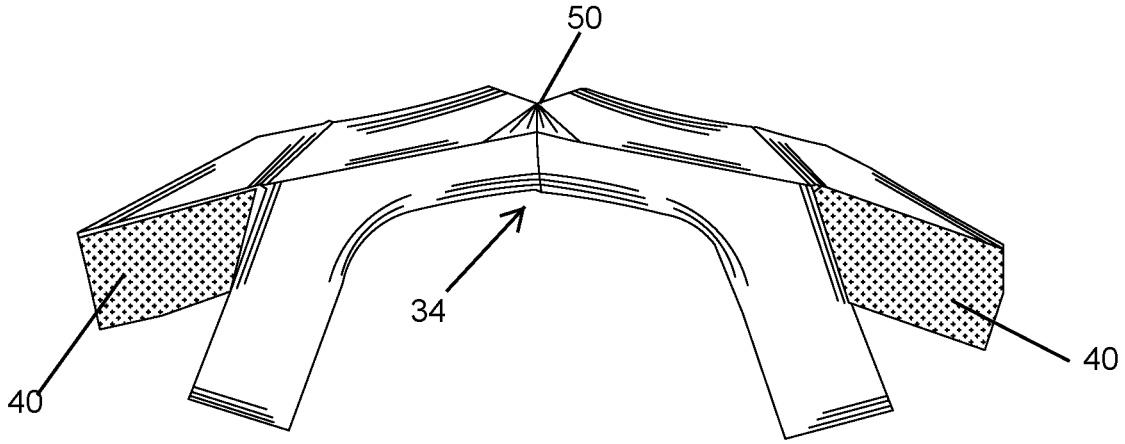
FIG. 17 is a bottom plan view of the upper lip shield, in accordance with a non-limiting exemplary embodiment of the present disclosure.
Figure 18:
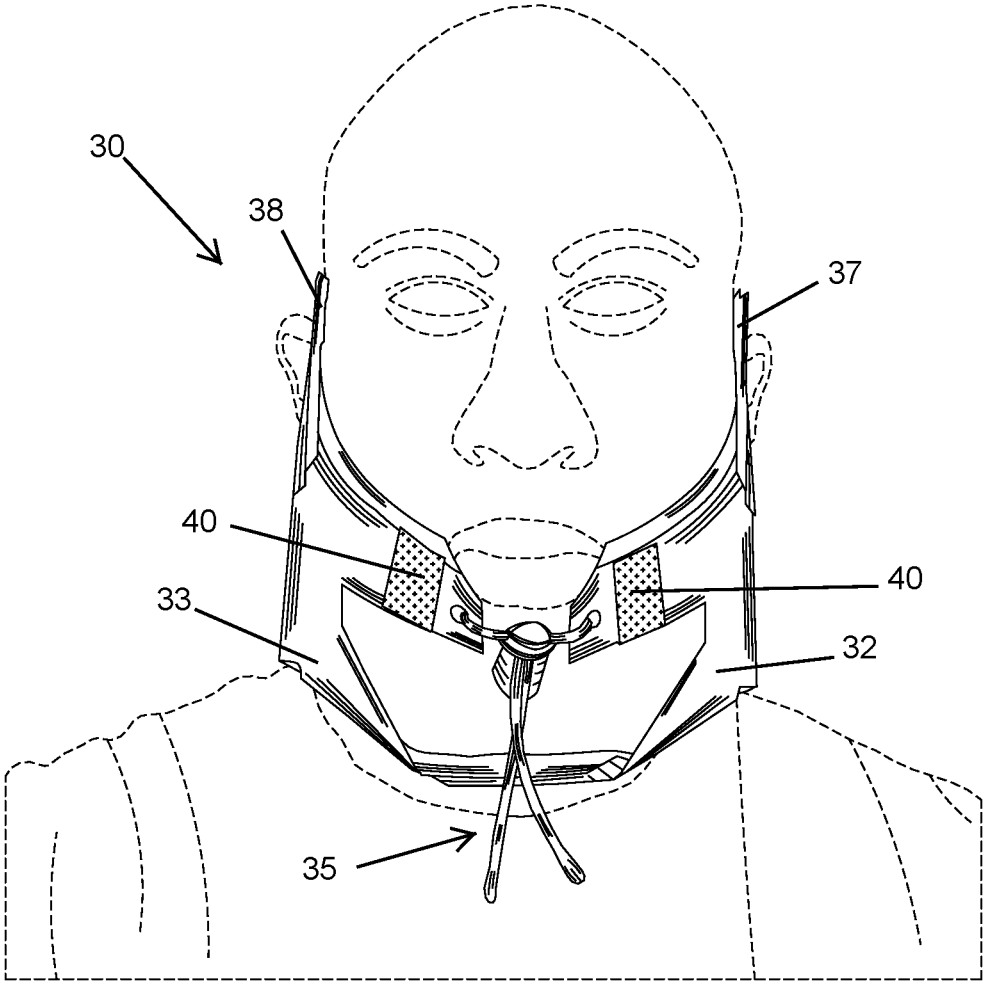
FIG. 18 is a front elevational environmental view showing the beard template mask positioned on a user's face, in accordance with a non-limiting exemplary embodiment of the present disclosure.
Figure 19:
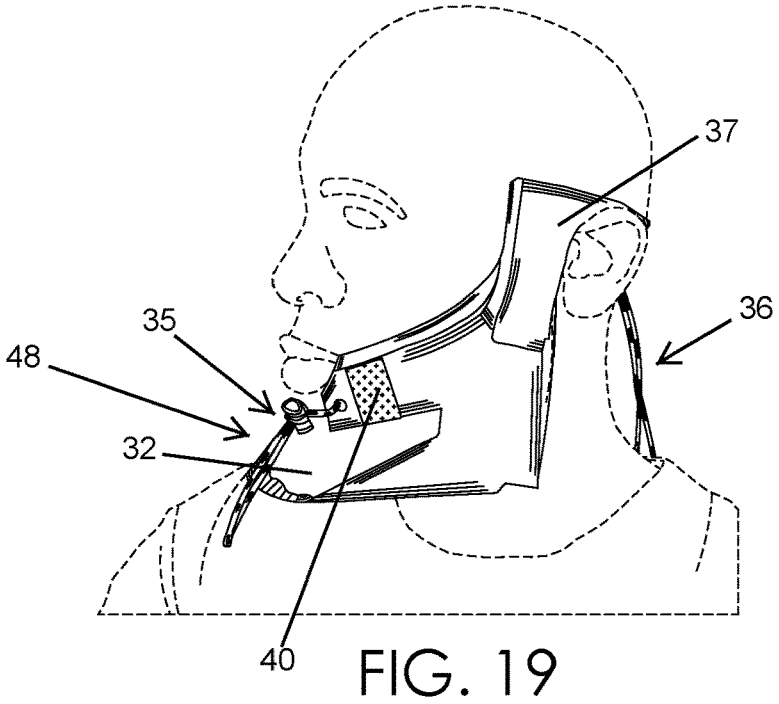
FIG. 19 is a side elevational environmental view showing the beard template mask shown in FIG. 18, in accordance with a non-limiting exemplary embodiment of the present disclosure.
Figure 20:
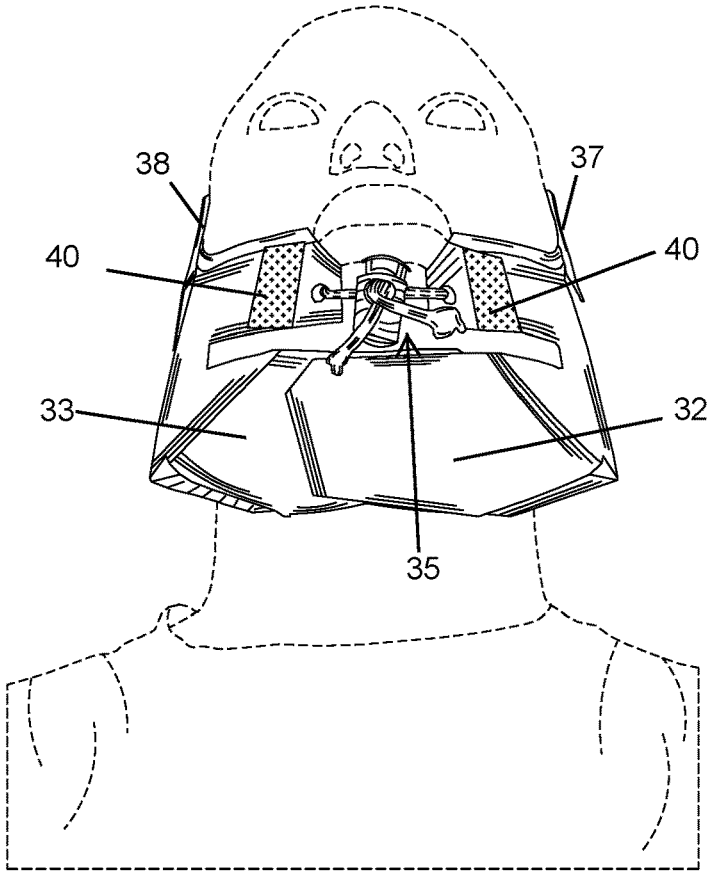
FIG. 20 is a perspective environmental view showing the beard template mask, shown in FIG. 18, in accordance with a non-limiting exemplary embodiment of the present disclosure.
Figure 21:
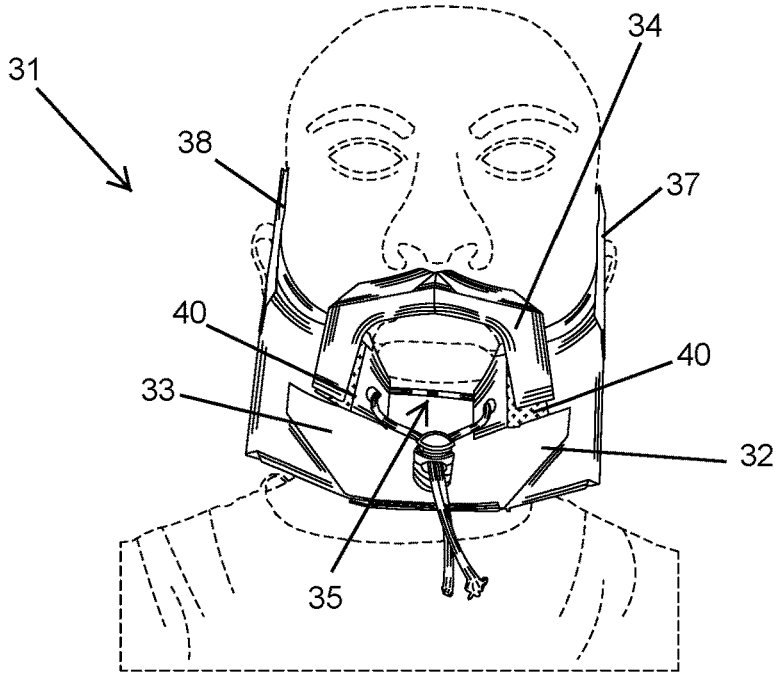
Figure 22:
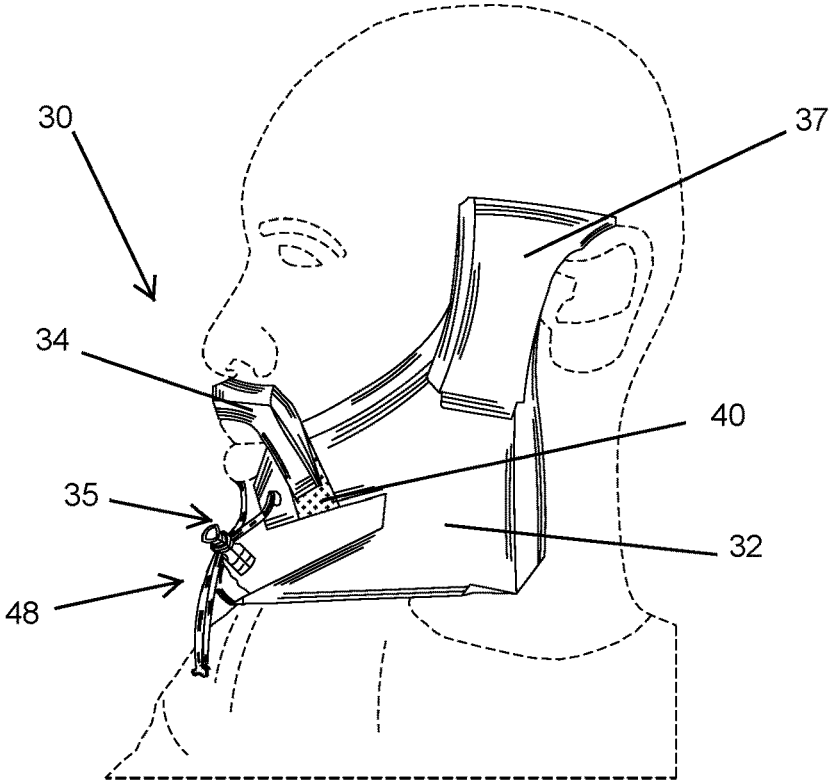

FIG. 21 is a front elevational environmental view showing the beard template mask, with the upper lip shield, positioned on a user's face, in accordance with a non-limiting exemplary embodiment of the present disclosure; and FIG. 22 is a side elevational environmental view of the beard template mask, with the upper lip shield, shown in FIG. 21, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means ±15% of the numerical.

If used herein, "substantially" means largely if not wholly that which is specified but so close that the difference is insignificant.

The term "earpieces" means "first support member" and "second support member."

Non-limiting exemplary embodiment(s) is/are referred to generally in FIGS. 1-22 and is/are intended to provide an adjustable and disposable beard template mask 30 for assisting a user to trim a beard. It should be understood that the exemplary embodiment(s) may be used to trim a variety of beard shapes and should not be limited to any particular beard shape described herein.

In a non-limiting exemplary embodiment, the beard template mask 30 is preferably made from high quality paperboard, polypropylene sheets, low profile hook/loop fasteners, and elastic cord(s). The paperboard may be SBS paper. It is the same material used for packing products. SBS paper is ideal because it has a rigidness to it but also has pliability. The rigidness gives protection against the trimmer from cutting into the beard template mask 30. This SBS paper does not tear easily if the trimmer grazes the edges. SBS paperboard is ideal for the shapes, cuts, and folds designed for the device. Its pliability gives the fluid nature of the contoured and folded lines needed to fit the face. SBS paperboard gives the user an alternative to perform a dry shave with an electric razor.

In a non-limiting exemplary embodiment, the beard template mask 30 may be made from polypropylene sheets. This plastic material is advantageous because it's extremely pliable compared to other plastics. This material can be used for wet shaving purposes.

SBS paperboard and polypropylene are preferred because not all users can handle wet shaves with a blade due the sensitive skin.

In a non-limiting exemplary embodiment, low-profile hook and loop fasteners 40 are employed because they keep the left side shield 32 and right side shield 33 flush when attached on top of one another. The elastic cords 35, 36 are helpful because they provide flexibility and comfort when tightened. The elastic cords 35, 36 provide comfort when the template sits on the user face rather than pressed on.

In a non-limiting exemplary embodiment, the left side shield 32 and right side shield 33 are adjustable via the hook and loop fasteners 40 for form-fitting to a variety of face and head sizes and contours. Each left side shield 32 and right side shield 33 has predetermined folds 55 (perforations, lines of weakness) that transform their respective shapes from 2D and fold to 3D. Every predetermined fold has a purpose for creating comfort and precision. The folds 55 act as guides and guards for protection. The folds 55 are guides that lay contour to the face and the desired beard shape. The folds 55 are also guards to protect the beard from cutting past the natural growth.

In a non-limiting exemplary embodiment, selected ones of the shield members 32, 33 preferably contain essential and functional surface indicia having predetermined measurement marks 41. The marks 41 are references for the user to keep the beard template mask 30 balanced and lined correctly to preform precisely. The marks 41 guide the user to widen or shorten in size. The marks 41 are located on the front part of the neck and sides of the neck to give adjustment to the exact curvature of the neck. This capability gives the user a chance to size their face based on the size (narrow/wide) of their beard growth.

In a non-limiting exemplary embodiment, the support members 37, 38 (earpieces) have folds 55 (lines of weakness, perforations) and predetermined measurement marks 41 for adjustment. The folds 55 act as guards for keeping the user from cutting into the sideburns unnaturally. The flaps 51 on earpieces 37, 38 are designed to fold back into the ear to keep it flush to the top of the beard. It has a tiny slit 50 for the template line to stay continuous to the desired cheek line whether it can be adjusted big or small. The marks 41 behind the earpiece 37, 38 are advantageous because they provide exact measurements based on the height of the face they need to adjust to. These lines show that the beard template mask 30 is balanced correctly. There is also a line that runs from the top to bottom of both earpiece 37, 38 and template to keep the template symmetrically positioned for use.

In a non-limiting exemplary embodiment, a plurality of holes 52 are located in the support members (earpieces) and shield members. Such holes 52 are placed at the end of the earpiece 37, 38 and front of the shield members for tightening the template. The front holes 52 give tightness to the cheeks while the holes 52 on the earpiece 37, 38 tighten for head size.

In a non-limiting exemplary embodiment, triangular slits 50 are located in the corners of the left side shield 32 and right side shield 33. Slits 50 bring the beard template mask 30 together when all parts fold along predetermined lines of weakness 55 (e.g., perforations) to crate the 3D shape. The triangular slits 50 are located three-quarters of the way up on the earpieces 37, 38 and are significant to the function of the earpieces 37, 38 because they allow the left side shield and right side shield and earpieces to align properly for continuity of a curved angle or straight angle when the beard template mask 10 adjusts to a face that is smaller in height. The triangular slits 50 also give a clean wrap around the beard template mask 10 when the back of the earpieces 37, 38 fold to lock in place.

In a non-limiting exemplary embodiment, upper lip shield 34 is a mustache piece. It attaches itself to a front of the left side shield 32 and right side shield 33. The upper lip shield 34 folds into a 3D shape that outlines a top of a mustache its associated sides. The upper lip shield 34 also has a small triangular slit 50 that makes the template come together when folded.

Referring to FIGS. 1-22 in general, in a non-limiting exemplary embodiment(s), the beard template mask 30 is formed from flat sheets of material (e.g., cardboard or the like) containing lines of weakness 55 (e.g., perforations) that define precise folds 55 to create overlapped parts so that the beard template mask 30 provides uniform continuity and adjustability while being disposable. Thus, a 3D template mask 30 is formed from 2D planar sheets of materials. This allows the template mask 30 to be form fitted and assembled on various user faces. Advantageously, there is no need to manually support the template mask 30 on a user's face via a user's hand.

Notably, all of the parts of the beard template mask 30 start out from a flat sheet of material. Each sheet of material has predetermined lines of weakness 55 (e.g., perforations) that fold into themselves to create a 3D beard template mask 30. The fold lines 55 are placed along the cheek line, side jawline, and neckline. Attached to such side shields 32, 33 are earpieces 37, 38 to keep the template mask 30 stable and secure and overlap with uniform continuity to the cheek line and side jaw line. As a whole, the template mask 30 can be adjusted up, down, widened, and taken in by adjusting the hook and loop fasteners 40. The template mask 30 is held together by strings on the earpieces 37, 38, side shields. The neck lines are attached via additional hook and loop fasteners 40 thereby creating a hands free and form fitting template mask 30 for the user's beard.

The present disclosure is adjustable and provides a uniform consistent template mask 30 for a user's beard. A truly hands-free template mask 30, the present disclosure overcomes inconsistence beard trimming at the cheek line. For example, a user does not have to sacrifice his dominant hand to shape the opposite side of his beard. The present disclosure provides a template mask 30 that includes shapes natural to a beard style allowing the user to follow an ideal shape of a beard contoured to the user's face.

The present disclosure provide uniform continuity and a proper hands-free approach to trimming one's own beard. It is disposable (environment friendly) and made from high quality cardboard that creases and folds 55 neatly and precisely for defining a uniform 3D and contoured shape for each user.

In a non-limiting exemplary embodiment, the template mask 30 may employ different angles and starting positions for the cheek line. For example, the cheek line will start at the middle of the lip where the crease is located.

In a non-limiting exemplary embodiment, the cheek line starts under the bottom of the lip.

In a non-limiting exemplary embodiment, the earpiece 37, 38 for the straighter angle, loses the curve on the edge.

In a non-limiting exemplary embodiment, a thinner version of the template mask 30 is provided for facial hair that doesn't grow as wide. Such an embodiment has a thinner earpiece 37, 38 and a thinner left side shield 32 and right side shield 33.

In non-limiting exemplary embodiments, the present disclosure includes fine, regular, and wide versions. All angles are the same with every width of each template mask 30. The linear earpieces 37, 38 are the same measurements as the curvilinear earpieces compatible with the curved template masks.

In non-limiting exemplary embodiments, short, medium, and long sizes are provided for both curved and straight edges of the earpiece 37, 38. They are all compatible with their designated widths for each template mask 30.

In a non-limiting exemplary embodiment, the mustache piece may have hook and loop fastener 40 tabs in the front of it, or behind it.

Referring to FIGS. 1-22 in general, a beard template mask 30 for assisting a user to trim a beard. The beard template mask 30 includes a flexible body 31 suitably sized and shaped to sit on a face of the user. Such a flexible body 31 includes a left side shield 32 suitably sized and shaped to cover a left side of a user face while exposing lips and a chin of the user, a right side shield 33 suitably sized and shaped to cover a right side of the user face while exposing the lips and the chin of the user, an upper lip shield 34 intermediately and detachably coupled to the left side shield 32 and the right side shield 33, and being suitably sized and shaped to cover a mustache region of a user face, a first fastener 35 removably attached to an anterior region 48 of the left side shield 32 and the right side shield 33, a second fastener 36 removably attached to a posterior region 49 of the left side shield 32 and the right side shield 33, a first support member 37 removably attached to the left side shield 32 and being configured to rest on a left ear of the user, and a second support member 38 removably attached to the right side shield 33 and being configured to rest on a right ear of the user. Each of the left side shield 32 and the right side shield 33 is generally L-shaped. Each of the first support member 37 and the second support member 38 is substantially L-shaped. Such a structural configuration yields the new, useful, and unpredicted result of providing a hands-free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

In a non-limiting exemplary embodiment, the plurality of measurement markings 41 are displayed on the first support member 37 and the second support member 38 and being configured to align the first support member 37 and the second support member 38 at a desired orientation to balance a left side of the user face with a right side of the user face. Such a structural configuration yields the new, useful, and unpredicted result of providing a hands-free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

In a non-limiting exemplary embodiment, a plurality of third fasteners 40 (hook and loop fasteners) are attached to the left side shield 32, the right side shield 33, the upper lip shield 34, the first support member 37, and second support member 38, respectively. Advantageously, the left side shield 32 is adjustably and detachably affixed to the first support member 37 and the upper lip shield 34. Advantageously, the right side shield 33 is adjustably and detachably affixed to the second support member 38 and the upper lip shield 34. Advantageously, each the first fastener 35 and the second fastener 36 are spaced apart from the third fasteners 40 (hook and loop fasteners), respectively. Such a structural configuration yields the new, useful, and unpredicted result of providing a hands-free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

In a non-limiting exemplary embodiment, a width of the body 31 is adjustable via the first fastener 35 and the second fastener 36 to conform to a contour of a face of the user. Such a structural configuration yields the new, useful, and unpredicted result of providing a hands -free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

In a non-limiting exemplary embodiment, the body 31 further includes an open anterior face disposed between the left side shield 32 and the right side shield 33 and positioned at the chin of the user. Such a structural configuration yields the new, useful, and unpredicted result of providing a hands-free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

In a non-limiting exemplary embodiment, each of the left side shield 32 and the right side shield 33 are configured to cover a major surface area of a left jaw region and a right jaw region of a user. Such a structural configuration yields the new, useful, and unpredicted result of providing a hands-free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

In a non-limiting exemplary embodiment, the upper lip shield 34 has an inverse and substantially U-shape and is configured to conform to a lip contour of the user lip and remain disposed beneath a nose of the user. Such a structural configuration yields the new, useful, and unpredicted result of providing a hands-free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

In a non-limiting exemplary embodiment, the first fastener 35 includes a first pair of elongated tethers 35*a,* and the second fastener 36 includes a second pair of elongated tethers 36*a* spaced from the first pair of elongated tethers 35*a.* Such a structural configuration yields the new, useful, and unpredicted result of providing a hands-free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

In a non-limiting exemplary embodiment, the first pair of elongated tethers 35*a* are tied together at the anterior region 48. Such a structural configuration yields the new, useful, and unpredicted result of providing a hands-free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

In a non-limiting exemplary embodiment, the second pair of elongated tethers 36*a* are tied together at the posterior region 49. Such a structural configuration yields the new, useful, and unpredicted result of providing a hands-free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

In a non-limiting exemplary embodiment, each of the first support member 37 and the second support member 38 has a substantially L-shape. Such a structural configuration yields the new, useful, and unpredicted result of providing a hands-free beard template mask 30 for allowing the user to shape his beard in a more natural and physical manner without having to sacrifice his dominate hand to shape his beard. The beard template mask 30 is truly hands free while targeting all angles of the beard. It folds into a compact template that is contoured to a desired beard shape while being customized for the user's face. It guides the user to fully trim his beard in a timely and precise manner.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A beard template mask for assisting a user to trim a beard, said beard template mask comprising: a flexible body suitably sized and shaped to sit on a face of the user, said flexible body including a left side shield suitably sized and shaped to cover a left side of the user face while exposing lips and a chin of the user;

a right side shield suitably sized and shaped to cover a right side of the user face while exposing the lips and the chin of the user;

an upper lip shield intermediately and detachably coupled to said left side shield and said right side shield, and being suitably sized and shaped to cover a mustache region of the user face;

a first fastener removably attached to an anterior region of said left side shield and said right side shield;

a second fastener removably attached to a posterior region of said left side shield and said right side shield;

a first support member removably attached to said left side shield and being configured to rest on a left ear of the user; and a second support member removably attached to said right side shield and being configured to rest on a right ear of the user.

2. The beard template mask of claim 1, wherein a width of said flexible body is adjustable via said first fastener and said second fastener to conform to a contour of the face of the user.

3. The beard template mask of claim 1, wherein said flexible body further includes an open anterior face disposed between said left side shield and said right side shield and positioned at the chin of the user.

4. The beard template mask of claim 1, wherein each of said left side shield and said right side shield are configured to cover a major surface area of a left jaw region and a right jaw region of a user.

5. The beard template mask of claim 1, wherein said upper lip shield has an inverse and substantially U-shape and is configured to conform to a lip contour of the user lip and remain disposed beneath a nose of the user.

6. The beard template mask of claim 1, wherein said first fastener includes a first pair of elongated tethers, and said second fastener includes a second pair of elongated tethers spaced from said first pair of elongated tethers.

7. The beard template mask of claim 6, wherein said first pair of elongated tethers are tied together at said anterior region.

8. The beard template mask of claim 6, wherein said second pair of elongated tethers are tied together at said posterior region.

9. The beard template mask of claim 1, further comprising: a plurality of third fasteners attached to said left side shield, said right side shield, said upper lip shield, said first support member, and second support member, respectively; wherein said left side shield is adjustably and detachably affixed to said first support member and said upper lip shield; wherein said right side shield is adjustably and detachably affixed to said second support member and said upper lip shield; wherein each said first fastener and said second fastener are spaced apart from said third fasteners, respectively.

10. A beard template mask for assisting a user to trim a beard, said beard template mask comprising: a flexible body suitably sized and shaped to sit on a face of the user, said flexible body including a left side shield suitably sized and shaped to cover a left side of the user face while exposing lips and a chin of the user;

a right side shield suitably sized and shaped to cover a right side of the user face while exposing the lips and the chin of the user;

an upper lip shield intermediately and detachably coupled to said left side shield and said right side shield, and being suitably sized and shaped to cover a mustache region of the user face;

a first fastener removably attached to an anterior region of said left side shield and said right side shield;

a second fastener removably attached to a posterior region of said left side shield and said right side shield;

a first support member removably attached to said left side shield and being configured to rest on a left ear of the user;

a second support member removably attached to said right side shield and being configured to rest on a right ear of the user; and a plurality of measurement markings displayed on said first support member and said second support member and being configured to align said first support member and said second support member at a desired orientation to balance the left side of the user face with the right side of the user face;

wherein each of said left side shield and said right side shield is generally L-shaped;

wherein each of said first support member and said second support member is substantially L-shaped.

11. The beard template mask of claim 10, wherein a width of said flexible body is adjustable via said first fastener and said second fastener to conform to a contour of the face of the user.

12. The beard template mask of claim 11, wherein said flexible body further includes an open anterior face disposed between said left side shield and said right side shield and positioned at the chin of the user.

13. The beard template mask of claim 12, wherein each of said left side shield and said right side shield are configured to cover a major surface area of a left jaw region and a right jaw region of the user.

14. The beard template mask of claim 13, wherein said upper lip shield has an inverse and substantially U-shape and is configured to conform to a lip contour of the user lip and remain disposed beneath a nose of the user.

15. The beard template mask of claim 14, wherein said first fastener includes a first pair of elongated tethers, and said second fastener includes a second pair of elongated tethers spaced from said first pair of elongated tethers.

16. The beard template mask of claim 15, wherein said first pair of elongated tethers are tied together at said anterior region.

17. The beard template mask of claim 16, wherein said second pair of elongated tethers are tied together at said posterior region.

18. The beard template mask of claim 10, further comprising: a plurality of third fasteners attached to said left side shield, said right side shield, said upper lip shield, said first support member, and second support member, respectively; wherein said left side shield is adjustably and detachably affixed to said first support member and said upper lip shield; wherein said right side shield is adjustably and detachably affixed to said second support member and said upper lip shield; wherein each said first fastener and said second fastener are spaced apart from said third fasteners, respectively.

* * * * *